United States Patent [19]

Spitzke

[11] 4,252,101

[45] Feb. 24, 1981

[54] DETACHABLE BOW MOUNTED QUIVER

[75] Inventor: Arthur Spitzke, Troy, Mich.

[73] Assignee: Schmelzer Corporation, Durand, Mich.

[21] Appl. No.: 36,559

[22] Filed: May 7, 1979

[51] Int. Cl.[3] ..... F41B 5/06

[52] U.S. Cl. ..... 124/45; 273/DIG. 2; 273/DIG. 4; 273/DIG. 8; 224/916

[58] Field of Search ..... 124/24 A, 23 A, 41 A, 124/51 R, 88, 86; 224/916

[56] References Cited

U.S. PATENT DOCUMENTS

| | | | |
|---|---|---|---|
| 2,999,620 | 9/1961 | Haggard | 124/24 A |
| 3,465,928 | 9/1969 | Osterholm | 224/916 X |
| 3,601,113 | 8/1971 | Wilkie | 124/24 A X |
| 3,777,734 | 12/1973 | Rose | 124/24 A |
| 4,020,984 | 5/1977 | Morris | 124/24 A X |

*Primary Examiner*—William R. Browne

*Attorney, Agent, or Firm*—Fisher, Gerhardt, Crampton & Groh

[57] ABSTRACT

A detachable quiver for bow mounting on a bow having a pair of mounting members mounted on the bow and formed integrally with a plastic quiver are maintained in connected condition by a resilient biasing arrangement formed integrally with one of the plastic mounting members.

9 Claims, 9 Drawing Figures

Fig-1
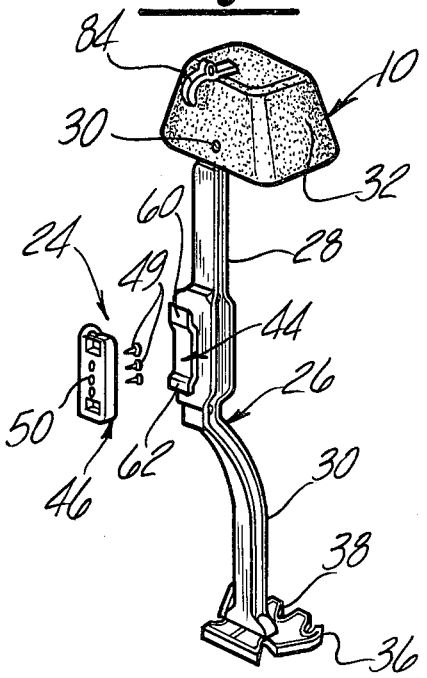
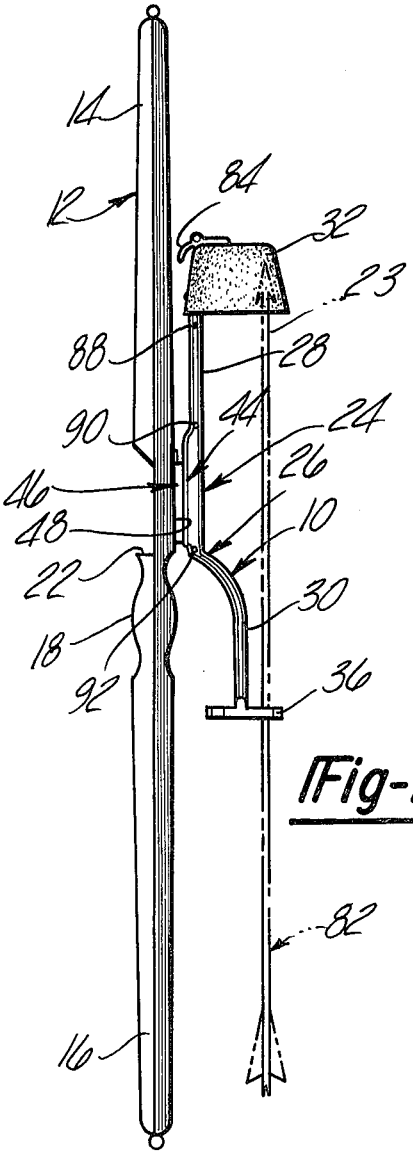
Fig-2
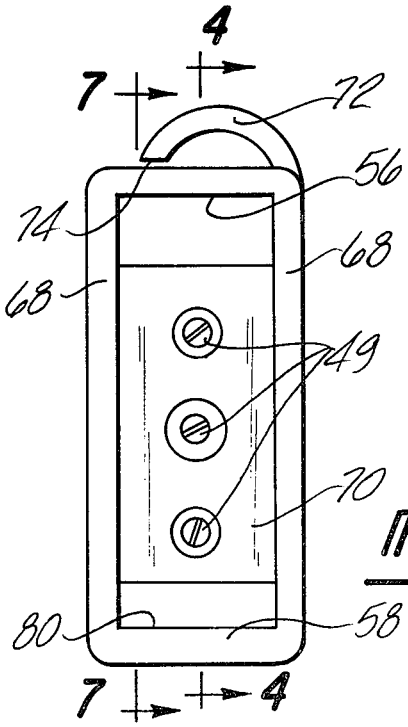
Fig-3

Fig-4
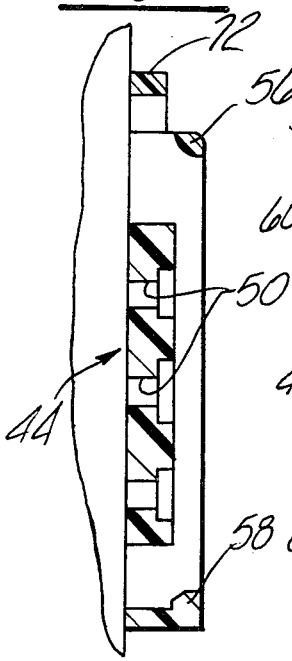
Fig-5
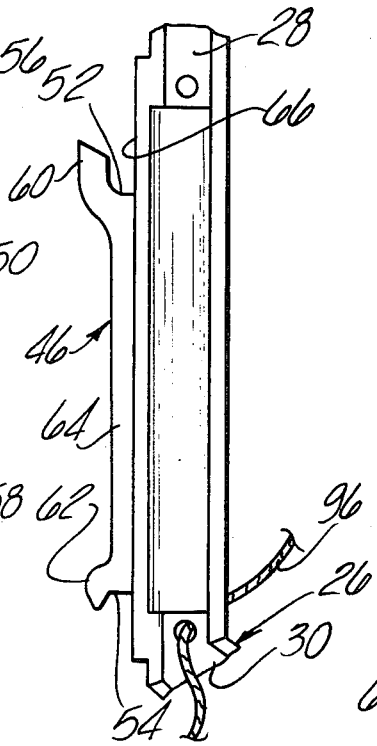
Fig-6
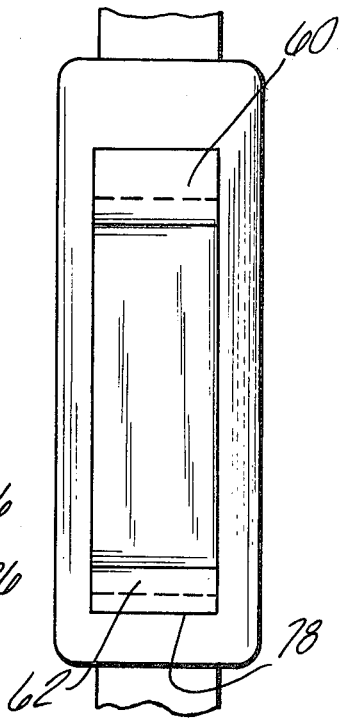
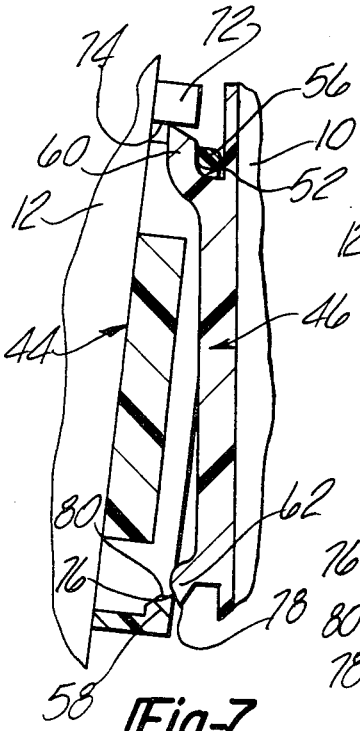
Fig-7
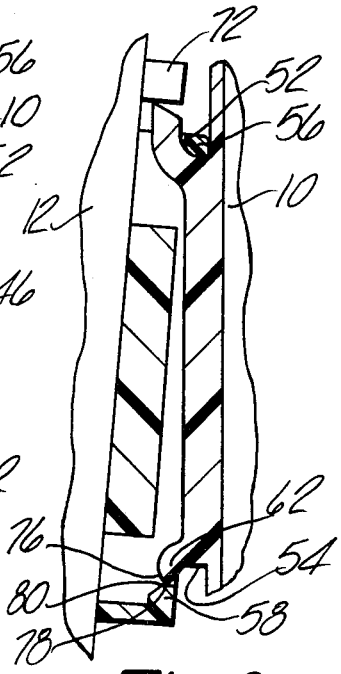
Fig-8
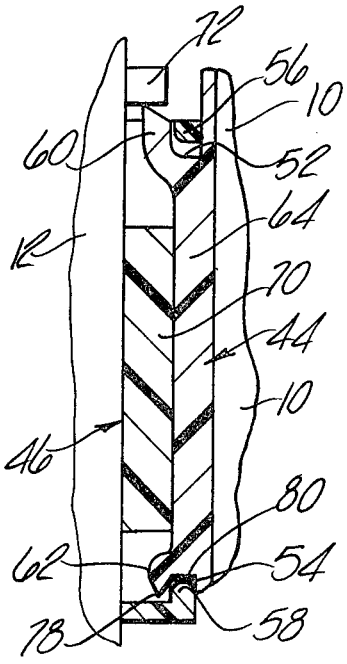
Fig-9

DETACHABLE BOW MOUNTED QUIVER

This invention relates to archery equipment and, more particularly, to quivers for detachable connection to an archery bow.

A large variety of bow-mounting quivers have been devised, each offering the advantage of having arrows arranged for convenient and rapid use. Such quivers must be securely supported on the bow in order to absorb vibrations created upon release of an arrow from the bow during shooting. At the same time the quiver must be easily removed when it is desired to use the bow without any encumbrance by the quiver. Also the quiver itself should have utility as a quiver when it is separated from the bow for target shooting, for example.

it is an object of this invention to provide an improved quiver for mounting on an archery bow which is arranged for rapid attachment and detachment and at the same time holds the quiver securely locked in position during shooting.

Another object of the invention is to provide a quiver which is mounted on a bow by an arrangement of simple construction which locks the quiver in position but employs a minimum number of parts.

Still another object of the invention is to provide an archery quiver for detachable connection to a bow wherein the components are all made of plastic and are incorporated in a minimum number of parts resulting in a quiver which is easily manufactured and assembled and which is durable, light, easily and quickly attached and detached from a bow and is highly efficient in use.

Another object of the invention is to provide a quiver which is balanced to minimize vibrations created during shooting of the bow.

These and other objects of the invention are accomplished by the embodiments disclosed in the following description and illustrated in the drawings in which:

BRIEF DESCRIPTION OF DRAWINGS

FIG. 1 is a perspective view of an archery quiver embodying the invention shown in association with bow mounted components;

FIG. 2 is a rear view of the bow as it would appear to the user of the bow;

FIG. 3 is an enlarged plan view of a component of the mounting structure seen in FIG. 1;

FIG. 4 is a cross-sectional view taken on line 4—4 in FIG. 3;

FIG. 5 is a rear elevation of a portion of the archery quiver showing the mounting structure in FIG. 1;

FIG. 6 is a plan view taken in the direction of arrows 6 in FIG. 5;

FIG. 7 is a cross-sectional view taken on line 7—7 in FIG. 3; and

FIGS. 8 and 9 are cross-sectional views similar to FIG. 7 of the bow and quiver associated mounting members illustrating the relationship of the members during attachment and detachment of the quiver from the bow.

An archery quiver embodying the invention is generally designated at 10 and is adapted to be mounted on an archery bow 12 having upper and lower flexible limbs 14 and 16, respectively, extending in opposite directions from a rigid handle area 18 having a hand grip 20 and an arrow rest 22 at one side of the hand grip 20.

The quiver 10 is adapted to hold a plurality of arrows, only one of which is shown at 23 in FIG. 1. The arrows are held in parallel space relation to each other and to the bow 12. The quiver 10 and arrows 23 are disposed at one side of the bow opposite to the arrow rest 22 as seen in FIG. 2. The archery quiver 10 is held on a bow by the mounting arrangement indicated generally at 24. The quiver itself is made entirely of plastic and includes a frame 26 made up of an upper arm 28 and a lower arm 30 extending in opposite directions from the mounting arrangement 24. The upper extremity of the upper arm 28 supports the housing 32 adapted to receive and hold the arrow heads 34. The details of the housing 32 are similar to the housing in the quiver disclosed in pending application, Ser. No. 973,229 filed Dec. 26, 1978.

As seen in FIGS. 1 and 2, the lower end of the lower arm 30 is provided with mounting members or a rack 36 having a plurality of notches 38 arranged in spaced apart relationship. The rack 36 is made of an elastomeric material such as a relatively softer plastic than that used in making the frame 26. A resilient rack 36 is adapted to grip the shafts of the arrows 23 and maintain them in spaced apart parallel relationship to each other.

The entire quiver 10 including the attaching arrangement 24, the frame 26, the housing 32 and rack 36 are made of plastic material. The housing 32 and frame 26 together with the attaching arrangement 24 are made of a relatively rigid plastic such as acrylonitrile butedyne styrene or a high density polyethylene and other components such as the rack 36 are made of a relatively softer plastic such as polyurethane. The cup shaped housing 32 is preferably molded as a separate part and is fastened to the upper arm 28 by means of a screw.

The attaching or mounting arrangement 24 includes a first mounting member 44 forming part of the quiver 10 and a second mounting member 46 which is attachable to the bow 12. As seen in FIGS. 1 and 2, the mounting member 46 is generally rectangular and is adapted to fit on a flat mounting surface 48 typically formed at one side of the handle area 18 of the bow 12 opposite the arrow rest 22. The mounting member 44 is fastened on the mounting surface 48 by means of screw fasteners 49 passing through the openings 50 and into the handle area 18.

The complementary mounting member 46 is formed integrally with the frame 26 of the quiver 10 at a point substantially mid-way between the housing 32 and rack 36. The mounting member 46, as best seen in FIGS. 1 and 5 has a pair of oppositely opening grooves 52 and 54 which, in the attached position of the quiver 10 on the bow 12, are adapted to receive latch elements 56 and 58, respectively, forming part of the mounting member 44. The grooves 52 and 54 are formed by tab elements 60 and 62 which extend in opposite directions from a pad portion 64 in slightly elevated relationship to a mounting surface 66 on the frame 26 of the quiver 10.

The latch elements 56 and 58 form the short ends of the generally rectangular mounting member 44 as seen in FIG. 3 and are disposed in spaced relationship to the mounting surface 48 as seen in FIG. 4. The latch elements 56 and 58 are held in spaced apart relationship by parallel side members 68 forming the long sides of the rectangular mounting member 44. Disposed between the walls 68 and in spaced relationship between the latch elements 56 and 58 is a mounting pad 70 forming the openings 50 for receiving screws 49 holding the mounting member on the bow 12.

In the connected position of the quiver 10 and bow 12 as best seen in FIG. 9, the latch elements 56 and 58 are disposed in the grooves 52 and 54, respectively, with the mounting pad 70 in engagement with the pad portion 64 associated with the quiver 10.

Referring now to FIGS. 3 and 4, one end of the mounting member 44 is provided with a hook 72 which is formed integrally with the remainder of the mounting member 46. The hook 72 acts as a biasing means or spring which is engageable with the tab element 60 during attachment and detachment of the quiver 10 from the bow and in the mounted position as illustrated in FIG. 8, acts on the mounting member 46 to urge it downwardly to insure that the tab element 62 remains in engagement with the latch element 58 formed at the lower end of the mounting member 46.

FIGS. 7 through 9 illustrate the relative positions of the mounting members 44 and 46 during both attachment and detachment of the quiver 10 relative to the bow 12. Assuming first that the quiver 10 and bow 12 are separated from each other, attachment begins as illustrated in FIG. 7 by placing the parts relative to each other so that the latch element 56 is disposed in the groove 52 on the mounting member 46. In this position the long tab element 60 is disposed in engagement with the free end 74 of the hook or spring 72 and the tab element 62 is engaged with an outer surface of the latch element 58 formed at the bottom of the mounting member 46.

The tab element 62 is formed with a cam surface 76 so that when the quiver 10 and bow 12 are moved toward each other the spring 72 is distorted slightly to permit the end 78 of the tab 62 to temporarily engage the surface 80 on the latch element 58 as seen in FIG. 8. During this movement the latch element 56 remains contained in the groove 52 to prevent separation of the mounting members 44 and 46.

The mounting member 46 can be moved from the position illustrated in FIG. 8 an additional amount to the position illustrated in FIG. 9 so that the tab element 62 moves from the surface 80 in which case the spring element 72 urges the mounting member 46 downwardly relative to the mounting member 44 so that the tab element 62 is disposed under the latch element 58 to prevent separation of the mounting members 44 and 46. It will be noted as viewed in FIG. 9 that the pad portions 64 and mounting pad 70 are in engagement with each other and that the latch elements 56 and 58 are disposed in the grooves 52 and 54 to prevent separation of the mounting members 44 and 46. In the mounted position of the quiver 10 on the bow 12, the pad portion 64 and mounting pad 70 remain in engagement with each other to insure that the tab elements 60 and 62 press against the underside of the latch elements 56 and 58. Also as best seen in FIG. 6 the tab elements 60 and 62 have a width substantially equal to the spacing of the walls 68 seen in FIG. 3 to insure a tight fit and prevent displacement of the mounting members 44 and 46 transversely relative to each other.

When it is desired to remove the quiver 10 from the bow 12 separation can be accomplished by moving the bow 12 downwardly and the quiver 10 upwardly as viewed in FIG. 2. This will cause the mounting members 44 and 46 to be moved relative to each other so that, as viewed in FIG. 9, the tab element 60 in engagement with the free end 74 of the spring 72 deflects it upwardly to permit the tab 62 to move upwardly so that the end 78 can clear the surface 80 and permit the quiver 10 and bow 12 to be moved relative to each other to assume the position illustrated in FIG. 8. Thereafter further separation of the bow and quiver moves the tab 62 completely out of engagement with the latch element 68 so that the bow 12 and quiver 10 can be separated from each other.

During use of the bow with the quiver in its attached position as illustrated in FIG. 2, the mass of the quiver 10 together with the arrows supported thereby is such that the mounting arrangement 24 is substantially at the center of the mass. As a result any vibrations resulting from use of the bow and transmitted to the quiver are distributed equally to the upper arm 28 lower arm 30. Even when the quiver 10 is unloaded and not supporting arrows, the mounting arrangement 24 is geometrically disposed mid-way between the housing 32 and rack 36 to maintain a balance between the quiver 10 and bow 12. The arrows 23 are supported in quiver 10 in such a manner that the unsupported portions of the arrows indicated at 82 are minimized to reduce vibrations that may be transferred to the unsupported portions of the arrows 23. The end of the housing 32 which shrouds the heads of the arrows 23 is provided with a hook 84 forming a mounting member by which the quiver 10 may be suspended from an attaching point such as a limb of a tree. This is a particular utility to hunters who may be located in a blind and who do not require the attachment of the quiver 10 to the bow 12.

The frame 26 of the quiver 10 is provided with openings indicated at 88, 90 and 92 in FIG. 2. The openings 88, 90 and 92 serve to receive one or more thongs 96 or other flexible elements by which the quiver 10 can be suspended in positions in readiness for use other than from the bow 12. For example, by the use of the thong 96 seen in FIG. 5, the quiver 10 can be supported from the belt of the user with the housing 32 disposed downwardly leaving the fletched ends 82 of the arrows 23 in position to be reached conveniently by the archer.

A bow mounted quiver for holding a plurality of arrows has been provided in which a pair of mounting members are supported relative to the bow and to the quiver, respectively in such a manner that they can be readily separated or attached to each other. The attachment arrangement includes a pair of oppositely opening slots which receive a pair of spaced attaching or latching elements. One of the mounting members has a spring formed integrally therewith which acts on the other mounting member to insure a constant biasing action maintaining the latching elements in engagement with the grooves. The weight distribution and geometrical dimensions of the quiver and mounting arrangement are such that vibrations from the bow to the quiver are minimized during shooting thereby minimizing loads on the latching element and arrow supported by the quiver.

The embodiments of the invention in which an exclusive property or privilege is claimed are defined as follows:

1. A quiver and mounting structure for detachably mounting a quiver on an archery bow, said quiver and mounting structure comprising; a quiver frame for supporting arrows in parallel spaced relationship to each other, first and second mounting members, one of said mounting members being supported on said frame, the other of said mounting members being adapted to be mounted on an archery bow, said first mounting member having spaced apart latch elements, said second mounting member having spaced apart oppositely facing grooves receiving said latch elements to maintain said mounting members connected together with said frame disposed to position arrows generally parallel to a bow, one of said grooves of said second mounting member being deeper than the other of said grooves to permit movement of one of said latch elements therein and relative movement of said members during positioning of the other of said latch elements in the other of said grooves, and biasing means associated with one of said members to urge the other of said members relative thereto and maintain the other of said latch elements in the other of said grooves.

2. The combination of claim 1 wherein said biasing means acts on said one latch element to resiliently limit movement of said one latch element in the associated groove and maintain the other of said latch elements in the other of said grooves.

3. The combination of claim 2 wherein said biasing means and one of said mounting members are formed of plastic material and are integral with each other.

4. The combination of claim 1 wherein said quiver and bow are separated from each other upon movement of said mounting members in one direction relative to each other against said biasing means to permit separation of one latch element from one groove and subsequently movement of said mounting elements in the other direction relative to each other to permit separation of the other latch element from its associated groove.

5. The combination of claim 1 wherein the mounting member on said quiver is disposed at a location substantially at the center of mass of said quiver and plurality of arrows held in said quiver.

6. The combination of claim 1 wherein said quiver has spaced supports for the heads of arrows and the shafts of arrows and wherein said mounting member on said quiver is disposed at a point substantially mid-way between said mounting members.

7. The combination of claim 1 and further comprising means forming a hanger on said quiver to suspend said quiver in a vertical position when said quiver is detached from said bow.

8. The combination of claim 7 wherein said means forming a hanger is a hook attached to the upper end of said quiver.

9. The combination of claim 1 wherein said quiver includes, supports for arrows at opposite ends of said frame, and means forming attaching points in said frame adapted to receive connectors when said quiver is detached from said bow.

* * * * *

UNITED STATES PATENT AND TRADEMARK OFFICE

CERTIFICATE OF CORRECTION

PATENT NO. : 4,252,101

DATED : February 24, 1981

INVENTOR(S) : Arthur Spitzke

It is certified that error appears in the above—identified patent and that said Letters Patent is hereby corrected as shown below:

Column 1, line 18, "it" should read --It--

Signed and Sealed this

*Fifteenth* Day of *December 1981*

[SEAL]

*Attest:*

GERALD J. MOSSINGHOFF

*Attesting Officer*

*Commissioner of Patents and Trademarks*